US010951974B2

(12) United States Patent
Keddem

(10) Patent No.: US 10,951,974 B2
(45) Date of Patent: Mar. 16, 2021

(54) APPARATUS AND METHOD FOR AUTOMATIC SHUTOFF OF AVIATION HEADSETS

(71) Applicant: David Clark Company Incorporated, Worcester, MA (US)

(72) Inventor: Natan Keddem, Upton, MA (US)

(73) Assignee: DAVID CLARK COMPANY INCORPORATED, Worcester, MA (US)

( * ) Notice: Subject to any disclaimer, the term of this patent is extended or adjusted under 35 U.S.C. 154(b) by 0 days.

(21) Appl. No.: 16/660,094

(22) Filed: Oct. 22, 2019

(65) Prior Publication Data

US 2020/0267467 A1 Aug. 20, 2020

Related U.S. Application Data

(60) Provisional application No. 62/805,391, filed on Feb. 14, 2019.

(51) Int. Cl.

| | |
|---|---|
| ***H04R 1/10*** | (2006.01) |
| ***G10K 11/178*** | (2006.01) |
| ***H04R 1/08*** | (2006.01) |

(52) U.S. Cl.

CPC ..... *H04R 1/1041* (2013.01); *G10K 11/1787* (2018.01); *H04R 1/08* (2013.01); *H04R 1/1033* (2013.01); *G10K 2210/1081* (2013.01); *H04R 2420/07* (2013.01)

(58) Field of Classification Search

CPC . H04R 1/1041; H04R 2420/07; H04R 1/1083

USPC ..... 381/74, 71.2, 71.8

See application file for complete search history.

(56) References Cited

U.S. PATENT DOCUMENTS

| | | | |
|---|---|---|---|
| 5,627,747 | A | 5/1997 | Melton et al. |
| 6,061,456 | A | 5/2000 | Andrea et al. |
| 6,078,672 | A | 6/2000 | Saunders et al. |
| 6,118,878 | A | 9/2000 | Jones |
| 6,278,786 | B1 | 8/2001 | McIntosh |
| 6,898,290 | B1 | 5/2005 | Saunders et al. |
| 7,110,551 | B1 | 9/2006 | Saunders et al. |
| 8,155,334 | B2 | 4/2012 | Joho et al. |
| 8,280,066 | B2 | 10/2012 | Joho et al. |
| 8,315,405 | B2 | 11/2012 | Bakalos et al. |
| 8,416,960 | B2 | 4/2013 | D'Agostino et al. |
| 8,571,228 | B2 | 10/2013 | Sapiejewski et al. |
| 8,675,885 | B2 | 3/2014 | Sapiejewski |
| 8,693,700 | B2 | 4/2014 | Bakalos et al. |
| 8,798,283 | B2 | 8/2014 | Gauger, Jr. et al. |

(Continued)

*Primary Examiner* — Alexander Krzystan

(74) *Attorney, Agent, or Firm* — Burns & Levinson LLP; Steven M. Mills

(57) ABSTRACT

A control system and method of selectively enabling an auto-shutoff feature of a control system for an aviation headset includes a power switch. The power switch is toggled and if the control system is in a powered down state, a startup sequence for the control system is initiated. During the startup sequence, a bias voltage detector checks for a bias voltage on a signal line of the headset. If a bias voltage is detected during the startup sequence, the auto-shutoff feature is enabled. The auto-shutoff feature periodically checks for a bias voltage and powers down the control system if no bias voltage is detected for a predetermined time interval. If no bias voltage is detected during startup, the auto-shutoff feature is disabled.

15 Claims, 2 Drawing Sheets

(56) References Cited

U.S. PATENT DOCUMENTS

| | | | | |
|---|---|---|---|---|
| 9,050,212 | B2 | 6/2015 | Gauger, Jr. | |
| 9,275,627 | B2 | 3/2016 | Schoerkmaier | |
| 9,294,836 | B2 | 3/2016 | Zhou et al. | |
| 9,430,999 | B2 | 8/2016 | Clemow | |
| 9,462,376 | B2 | 10/2016 | Alderson | |
| 9,578,415 | B1 | 2/2017 | Zhou et al. | |
| 9,589,557 | B2 | 3/2017 | Carreras et al. | |
| 9,628,914 | B2 | 4/2017 | Gauger, Jr. | |
| 9,728,179 | B2 | 8/2017 | Kumar et al. | |
| 9,747,887 | B2 | 8/2017 | O'Connell et al. | |
| 9,779,714 | B2 | 10/2017 | Theiler et al. | |
| 9,779,718 | B2 | 10/2017 | Gether et al. | |
| 9,818,394 | B2 | 11/2017 | Fuller | |
| 9,837,066 | B2 | 12/2017 | Wurtz | |
| 9,881,601 | B2 | 1/2018 | Bames et al. | |
| 9,894,452 | B1 | 2/2018 | Termeulen et al. | |
| 9,922,636 | B2 | 3/2018 | Ku | |
| 2004/0264706 | A1 | 12/2004 | Ray et al. | |
| 2005/0213779 | A1 | 9/2005 | Coats | |
| 2007/0299354 | A1* | 12/2007 | Striepe | A61B 5/02405 600/509 |
| 2008/0057857 | A1* | 3/2008 | Smith | H04R 1/1033 455/3.05 |
| 2010/0034398 | A1 | 2/2010 | Odent et al. | |
| 2010/0060586 | A1* | 3/2010 | Pisula | G06F 3/04886 345/169 |
| 2010/0105447 | A1 | 4/2010 | Sibbald et al. | |
| 2012/0250873 | A1 | 10/2012 | Bakalos et al. | |
| 2013/0148818 | A1* | 6/2013 | Yamkovoy | H04R 1/1041 381/74 |
| 2013/0229508 | A1* | 9/2013 | Li | G06F 1/3287 348/77 |
| 2014/0044275 | A1 | 2/2014 | Goldstein et al. | |
| 2015/0382096 | A1* | 12/2015 | Lamar | H04R 1/1083 381/74 |
| 2016/0035342 | A1* | 2/2016 | Lee | G10K 11/17821 381/309 |
| 2017/0110106 | A1 | 4/2017 | Kumar et al. | |
| 2017/0127171 | A1 | 5/2017 | Haworth | |

* cited by examiner

APPARATUS AND METHOD FOR AUTOMATIC SHUTOFF OF AVIATION HEADSETS

CROSS REFERENCE TO RELATED APPLICATIONS

This application claims priority to and the benefit of U.S. Provisional Patent Application No. 62/805,391, filed on Feb. 14, 2019 and titled "APPARATUS AND METHOD FOR AUTOMATIC SHUTOFF OF AVIATION HEADSETS", the contents of which are incorporated herein by reference as though fully set forth herein.

FIELD OF THE TECHNOLOGY

The subject disclosure relates to headsets, and more particularly to control systems for aviation headsets.

BACKGROUND OF THE TECHNOLOGY

Electronic noise attenuating headsets most often use batteries to power the noise cancelling circuit. There is an electronics controller in line with the communications cable running from the headset to the aircraft communications panel. Historically, pilots would turn on the battery-powered noise cancelling before a flight and then often forget to turn it off after the flight, which led to the draining of the batteries before the next flight. The industry introduced auto-shutoff control systems to address this problem. Currently, auto-shutoff control systems work by checking for the presence of a microphone bias voltage on the microphone line connecting the communications panel and headset. If the microphone bias voltage is not seen by the controller for a prescribed period of time, the controller will assume the aircraft power is turned off or the headset is unplugged, which indicates the flight is complete, and will power down the electronic noise cancelling control system, thus saving the batteries from draining before the next flight.

However, there are some aircraft that do not have microphone bias on the line on a consistent basis. This can then cause the shutdown of the headset before the end of the flight, since the headset controller doesn't see the microphone bias voltage. To address this problem, some conventional headsets with an auto-shutoff feature also have the ability to disable this feature via a switch available to the user. A drawback of this capability of manually disabling the auto-shutoff, is that if the auto-shutoff feature is not enabled, the user may forget to shut off the headset control system, and the batteries are inadvertently drained, which, of course, is the original problem such control systems were intended to prevent.

SUMMARY OF THE TECHNOLOGY

In light of the needs described above, in at least one aspect, the subject technology relates to a device which automatically selectively enables or disables an auto-shutoff for a noise canceling feature of an aviation headset.

In at least one aspect, the subject technology includes a method of selectively enabling an auto-shutoff feature of a control system for a headset. A power switch is toggled to initiate a startup sequence and power up the control system. If the power switch is toggled when the control system is powered up, the control system is powered down. After the startup sequence is initiated, the control system checks for a bias voltage on a signal line of the headset during the startup sequence. An auto-shutoff feature is enabled if a bias voltage is detected during the startup sequence. The auto-shutoff feature periodically checks for a bias voltage and powers down the control system and headset if no bias voltage is detected for a predetermined time interval. The predetermined time interval can be substantially 60 seconds.

In some embodiments, the auto-shutoff feature also checks for active stimuli of the headset, the auto-shutoff feature only powering down the control system and headset when neither bias voltage nor active stimuli are detected for the predetermined time interval. The active stimuli can include a telephone call over Bluetooth. In some embodiments, the control system controls features of audio communication conducted via the headset. In some embodiments, the control system includes a circuit providing a noise cancelling feature to the headset. In some cases, the headset is an aviation headset and the method includes, prior to toggling the power switch to initiate the startup sequence, plugging the headset into a headset jack of an aircraft to electrically connect the signal line to the aircraft. Plugging the headset into the headset jack can provide power to a microphone of the aviation headset.

In at least one aspect, the subject technology includes a control system for a headset. The control system includes a bias voltage detector configured to detect a bias voltage on a signal line of the headset. The control system also includes a power switch configured such that when toggled when the control system is in a powered down state, a startup sequence is initiated for the control system. The power switch is further configured such that when toggled when the control system is in a powered up state, the control system is switched into the powered down state. The control system includes a controller configured to enable an auto-shutoff feature when the bias voltage detector detects a bias voltage during the startup sequence. The auto-shutoff feature periodically checks whether the bias voltage detector is detecting a bias voltage and powers down the control system and the headset when no bias voltage is detected for a predetermined time interval. The predetermined time interval can be substantially 60 seconds.

In some embodiments, the auto-shutoff feature is further configured to check for active stimuli of the headset, the auto-shutoff feature only powering down the control system and the headset when neither bias voltage nor active stimuli are detected for the predetermined time interval. The active stimuli can include a telephone call over Bluetooth. In some cases, the control system is configured to control audio communication conducted via the headset. The control system can include a circuit configured to provide a noise cancelling feature to the headset.

In at least one aspect, the subject technology includes an aviation headset for an aircraft. The headset includes a microphone connected to a signal line. The headset includes a headset plug configured to connect the signal line to a headset jack in the aircraft to electrically connect the aviation headset and the aircraft. The headset includes a battery configured to power a control system connected to the aviation headset. The control system includes a circuit providing a noise cancellation feature to the aviation headset. The control system includes a bias voltage detector configured to detect a bias voltage on the signal line from the aircraft. The control system includes at least one sensor for detecting active stimuli on the signal line. The control system includes a power switch configured such that when toggled when the control system is in a powered down state, a startup sequence is initiated for the control system. The power switch is further configured such that when toggled when the control system is a powered up state, the control system is switched into the powered down state. The control system further includes a controller configured to enable an auto-shutoff feature for the headset if the bias voltage detector detects a bias voltage during the startup sequence. The auto-shutoff feature periodically checks whether the bias voltage detector is detecting a bias voltage and powers down the headset when neither a bias voltage nor active stimuli are detected for a predetermined time interval. In some embodiments, the signal line is configured to provide power from the aircraft to the microphone when the headset is connected to the aircraft.

BRIEF DESCRIPTION OF THE DRAWINGS

So that those having ordinary skill in the art to which the disclosed control system pertains will more readily understand how to make and use the same, reference may be had to the following drawings.

DETAILED DESCRIPTION

Figure 1:
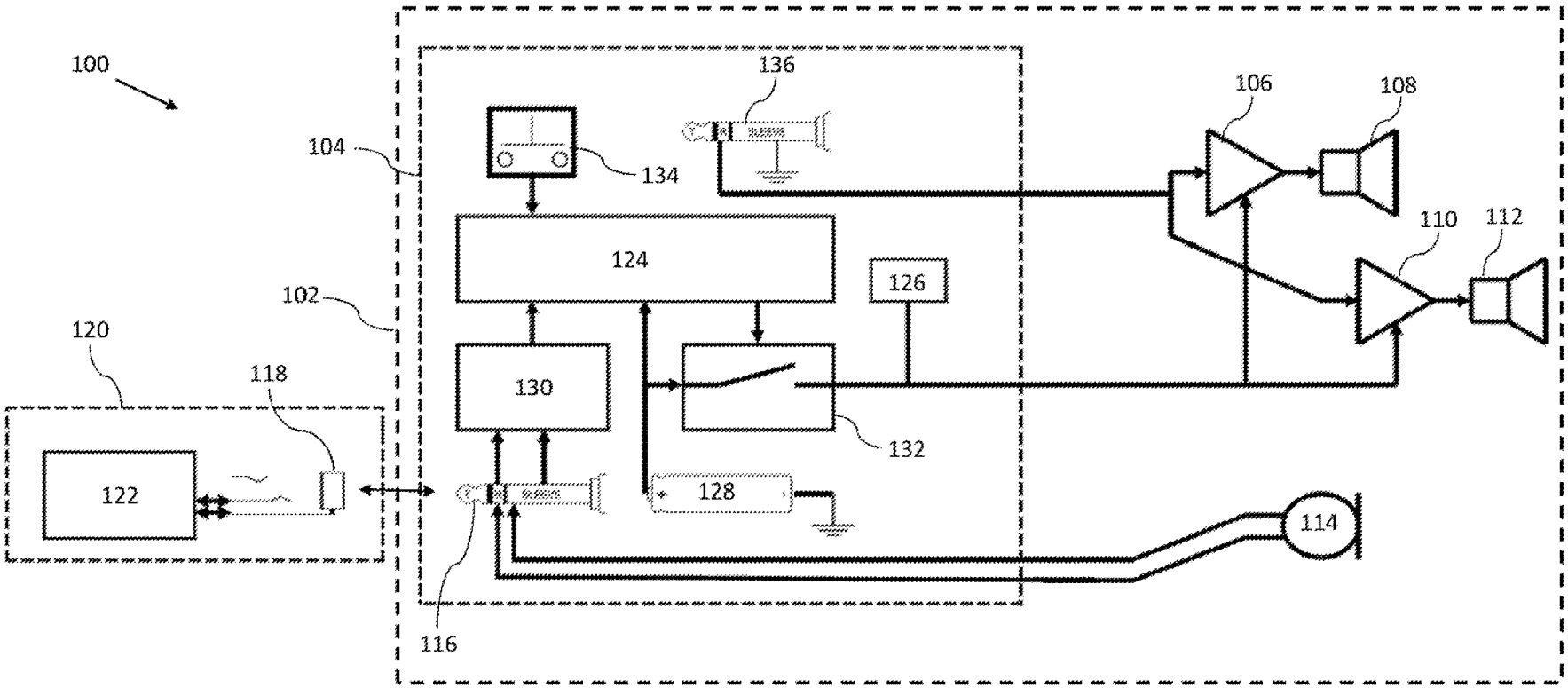
FIG. 1 is a block diagram of an aviation headset connected to an aircraft in accordance with the subject technology.

The subject technology overcomes prior art problems associated with aviation headsets. The advantages, and other features of the control systems and methods disclosed herein, will become more readily apparent to those having ordinary skill in the art from the following detailed description of certain preferred embodiments taken in conjunction with the drawings which set forth representative embodiments of the present invention. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

Referring now to FIG. 1, a block diagram 100 of an aircraft 120 and an aviation headset 102 with a headset control system 104 in accordance with the subject technology is shown. The headset 102 has audio components for playing audio to a user, including a left speaker driver 106 and left speaker 108 and a right speaker driver 110 and right speaker 112. The headset 102 also includes a microphone (and amplifier) 114 which can receive and transmit audio from the user. A signal line runs through the headset 102 and connects the headset 102 to a headset plug 116. The headset plug 116 is configured for insertion into a headset jack 118 of the aircraft 120 to electrically connect the headset 102 to the aircraft 120.

Notably, in the embodiment shown, the headset plug 116 is connected directly to the microphone 114 and the components of the control system 104, while the speakers 108, 112 are connected separately to the components of the control system 104 and a separate plug 136. In such a case, the headset plug 116 would connect to a headset jack of the airplane for talk audio while the other headset plug 136 would connect to a headset jack of the airplane for listen audio. However, it should be understood that depending on the aviation application, the plugs 116, 136 can be combined into a single plug which connects microphone 114 and speakers 108, 112 to the airplane (via a connection to a single headset jack of the airplane) for both talk and listen capabilities.

The aircraft 120 can include a bias source 122 which provides power to the microphone 114, allowing the microphone 114 to operate. The bias source 122 also senses audio voltage signals created by the microphone 114 and feeds the signals to the rest of an aviation audio panel (not distinctly shown).

The control system 104 is fully integrated into the headset 102 and, generally, controls features of the headset 102 functionality, as discussed in more detail herein. The control system 104 includes a controller 124 configured to receive stimulus, carry out central logic functions and/or programming of the control system 104, and control devices of the control system 104 through output stimulus. The controller 124 can be discrete circuitry, a microprocessor connected to memory and configured to carry out programmed instructions, or other controller type as are known in the art. The headset 102 also includes other circuitry 126 which can supply various headset features. For example, the circuitry 126 can include a noise cancelling feature which is provided directly to the drivers for the left and right speaker 106, 110. The control system 104 is powered by a battery 128, which can also power the headset 102 generally.

A bias voltage detector 130 monitors the headset 102 signal lines and determines if a bias voltage is currently present on the microphone line. In most aircrafts, bias will be present after the headset plug 116 is connected to the headset jack 118. The headset plug 116 will typically include a sleeve while the headset jack includes a ring which surrounds the sleeve when the headset plug 116 is within the headset jack 118. The bias is the result of a voltage potential difference between the sleeve and ring. The voltage potential excites a circuit in the bias voltage detector 130, allowing it to detect bias. The bias voltage detector 130 provides status information on the current state of the bias voltage (i.e. whether a bias is detected) to the controller 124. This in turn suggests that the headset 102 is plugged into the aircraft 120 and ready for use.

The control system 104 includes a headset power circuit 132 between the battery 128 and headset speakers 108, 112 which dynamically controls whether the headset 102 is in a powered up or powered down state. A power switch 134 provides a physical mechanism, such as a pushbutton or other switch type, which the user can toggle between on and off positions, depending on whether they want the headset 102 to be powered up or down. The power switch 134 position (i.e. on or off) is reported to the controller 124, which can then close or open the headset power circuit 132 to enable or disable voltage to most of the components of headset 102, as the case may be. Opening the power circuit 132 will not stop power from the battery 128 from reaching the controller 124, which will remain in a low power state to monitor power switch 134 even when the headset 102 has generally been powered down. In general, when the headset 102 is in a powered up state, toggling the power switch 134 will cause the headset 102 to power down. On the other hand, if the headset 102 is in a powered down state, toggling the power switch 134 will cause the headset 102 to power up and initiate a startup sequence.

The control system 104 can also provide an auto-shutoff feature which controls whether the noise cancelling feature will be provided. The goal of the auto-shutoff feature is to make sure that when the headset 102 is not in use, power is conserved. Thus, the auto-shutoff feature can be designed to turn off the noise cancelling feature, and/or other features which use energy and drain the battery, including the entire headset 102, when the headset 102 is not in use. As such, the auto-shutoff feature is configured such that if no bias is sensed on the signal line the headset 102, and particularly on the microphone 114 line, power is turned off. However, not all aircrafts consistently create a bias on the signal line of the headset 102. As disclosed herein, auto-shutoff feature is only activated if, during the startup initiation sequence, a bias is detected. As such, during the startup sequence, the bias detector checks 130 for a bias voltage on the signal line of the headset 102. If a bias is detected during startup, the auto-shutoff feature is enabled. Further, the bias detector periodically checks for a bias voltage after startup and powers down the control system 104, components of the headset 102, or entire headset, when no bias is detected for a predetermined time interval.

Figure 2:
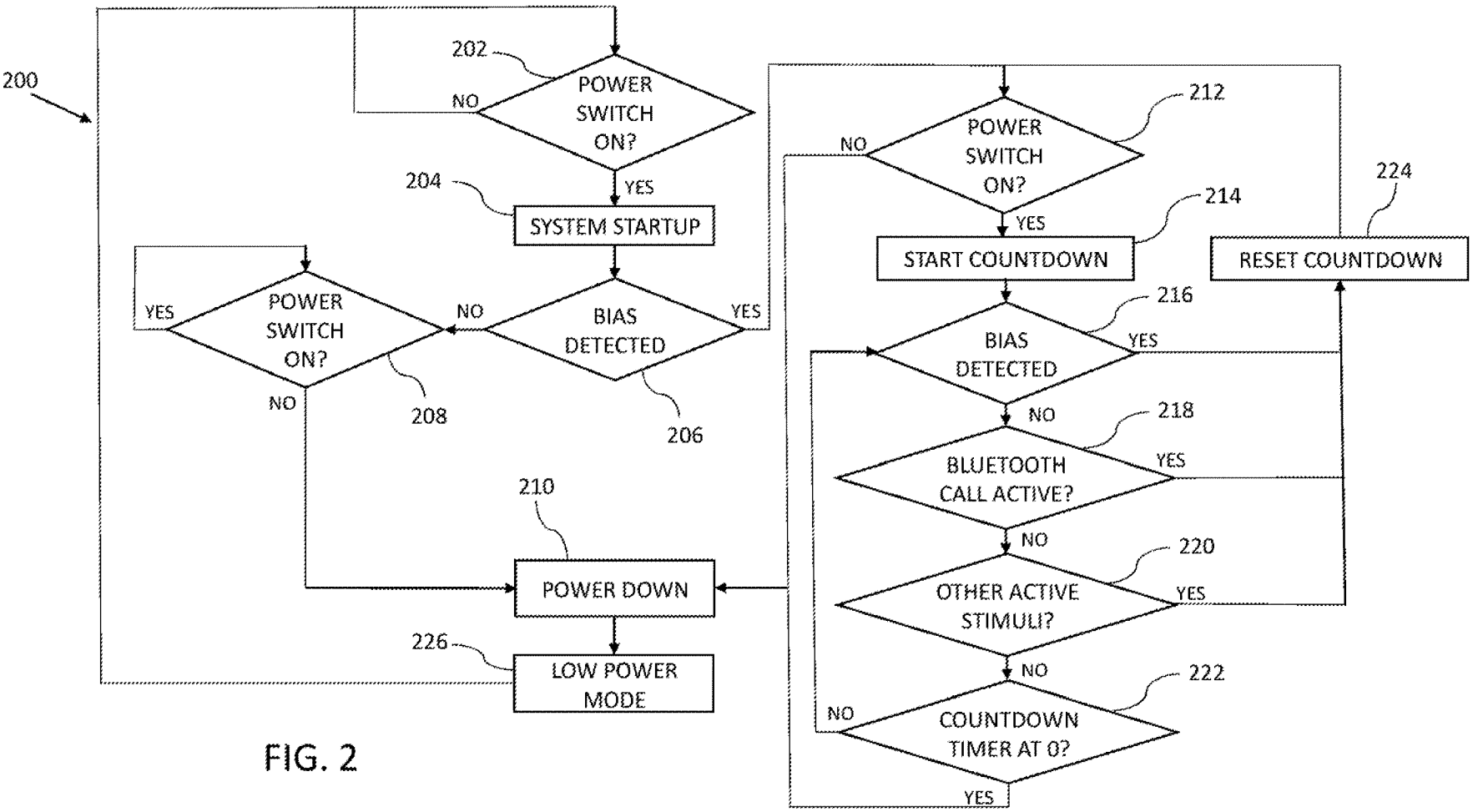
FIG. 2 is a logical flowchart for a method of controlling an aviation headset in accordance with the subject technology.

Referring to FIG. 2, a logical flowchart 200 for a method of controlling a system for an aviation headset in accordance with the subject technology is shown. The method of flowchart 200 can be carried out using the physical components shown in FIG. 1 and described herein. At step 202, the flowchart 200 beings with the headset in a powered down state (e.g. a low power state) in which the headset does little other than check the position of the power switch. When the power switch is toggled into an "on" position, the headset is powered on and a startup sequence is initiated at step 204, where system startup operations are performed. As part of the startup sequence, the bias detector checks for a bias voltage on a signal line of the headset, at step 206, and determines whether to enable an auto-shutoff feature accordingly. As discussed above, not all aircraft cause a bias on the headset signal line. Therefore, if no bias is detected during startup, the method proceeds to step 208. At step 208, the auto-shutoff is disabled and thereafter the system will only shut down if the power switch is toggled into the "off" position. Therefore at step 208, the system monitors the state of the power switch, and if toggled into the off position, the system begins power down actions at step 210.

On the other hand, if a bias is detected at step 206, the system proceeds down a separate path where the auto-shutoff is enabled, starting with step 212. At step 212, the system again checks to make sure the power switch is still in the on position. If the power switch is instead in the off position, the method proceeds to power down actions at step 210. Note that step 212 is a simple check to make sure the power switch has not been toggled into the off position which can be carried out periodically to ensure the system shuts down if the user has attempted to turn the power off. While step 212 is shown as being carried out directly after step 206, it should be understood that step 212 can be carried out at different points of the method 200, and at different points during the auto-shutoff routine. Thus, step 212 is repeated periodically at a point of the method 200 so that the system is powered down if the power switch is toggled into the off position.

At step 214, the system begins a countdown. The countdown is a pre-set time interval during which, if no bias is detected, and no other known stimuli is detected, it will be assumed that the headset is no longer in use and the auto-shutoff feature will begin the power down sequence at step 210. The time interval is preset, and reflects an amount of time that must pass such that it is likely the headset is actually no longer in use, rather than still in use but exhibiting a brief interruption in the bias voltage on the signal line. While in some cases, the pre-set time interval can effectively be set to be a short time period, such as several seconds, it can be advantageous to have a longer delay before the system shuts down so that brief bias interruptions while the headset is still in use do not initiate the shutdown sequence. For example, in some cases a time interval of substantially 60 seconds (i.e. 60 seconds give or take 10 seconds) has been found to be effective. Other time intervals can also be used.

After the countdown begins at step 214, several checks are done to see if the system should initiate a shutdown due to the headset no longer being in use. At step 216, another check for bias on the signal line of the headset is done, similar to the check done at step 206. In step 216, if bias is detected on the signal line, then there is no need to begin a shutdown sequence because the headset is likely still in use. Therefore the method proceeds to step 224 where the countdown is reset and the entire auto-shutdown procedure starts over, either immediately or after some delay, starting with step 212 (or starting with step 214, if step 212 is carried out at a different point during the method 200). If bias is not detected at step 216, then the system needs to check for additional stimuli that may be interrupting the bias on the signal line, and therefore the method moves to step 218.

At step 218 the system checks for whether a Bluetooth call is active. If a Bluetooth call is active, bias might not be detected on the headset signal line during step 216, however, the headset would still be in use. Therefore, if a Bluetooth call is found to be active at step 218, the method proceeds to step 224 where the countdown is reset, as discussed above. If no Bluetooth call is found at step 218, then the method proceeds to step 220 where a check is done for other active stimuli. The other active stimuli can include anything that might be expected to interfere with the voltage bias on the signal line, thus preventing detection of bias even though the headset is active and in use. To that end, the system can include one or more sensors for detecting other active stimuli. These sensors can be configured to monitor the audio of speakers and/or the microphone for active audio signals. Furthermore, the system can include other sensors which monitor the environment outside the audio of the headset to determine if the headset is in use. For example, the system can include sensors such as proximity, movement, and/or vibrational sensors which detect when the user is active in the area for other active stimuli. If other active stimuli are detected at step 220 by one or more of the sensors, the method proceeds to step 224 and resets the countdown. If other active stimuli are not detected at step 220, the method continues to step 222. Notably, in other embodiments, the steps 216-220 can be carried out in any possible order. It is only important that no bias is detected, and no active stimuli are found interrupting the bias (or otherwise) for the duration of the time interval for the shutdown procedure to be initiated at step 210.

If no other active stimuli are detected at step 220, the method proceeds to step 222 where the system checks the countdown timer to see if the predetermined time interval has passed. If the predetermined time interval has not passed, at step 222, the steps of checking for bias 216, checking for a Bluetooth call 218, and checking for active stimuli 220 are repeated. If the countdown has reached 0, then the predetermined time interval has passed, and the system can assume the lack of bias or other stimuli is the result of the headset no longer being in use. The method can proceed to step 210 for the power down initiation pursuant to the auto-shutoff feature of the system. Therefore when the auto-shutoff feature is enabled, the system can either be shut down by a manual power switch, at step 212, or by a lack of bias or other stimuli for the predetermined time interval. By contrast, when the auto-shutoff feature is not enabled, at step 208, the system can only be shut off by toggling the power switch.

Optionally, at step 226, the system, though powered down, can be operated in a low power mode where the system takes little action other then monitoring for the power switch to be toggled, at step 202. All other system and headset components are off and without power, and therefore the low power mode is considered a powered down state. For example, as shown in FIG. 1, the power circuitry 132 can be opened in the low power mode, allowing the battery 128 to power the controller 124 for monitoring the power switch 134, while power from the battery 128 is closed off from to the other circuitry 126, and speakers 108, 112. If the power switch is toggled at step 202, the system is powered back up (i.e. into a full powered state, leaving low power mode) and the method 200 can be repeated.

Therefore, the system and methods described herein related to enhanced auto-shutoff feature, that automatically disables an auto-shutoff feature when it is expected to be detrimental and enables the auto-shutoff feature when the system can correctly identify when the headset is no longer in use. That is, if microphone bias is present on a signal line, the system will not initiate a shutdown until the bias, as well as other stimuli that may have interrupted the bias, are gone for a predetermined time interval. No input is required from the headset user other than toggling the power switch to turn the headset on or off, as they normally must do. The user does not, for example, need to select a correct mode of operation of the headset by toggling any switches. Doing so can be confusing for the user, as they have to determine and select the correct mode of operation. Manual input can also be unreliable since it depends on the user remembering to carry out this manual input step. Instead, in the subject technology, the proper mode of operation is automatically determined through the system and method described herein. Notably, it should be understood that in all of these scenarios described above it is assumed that the headset is plugged into the aircraft communications panel and the aircraft is powered on, which is typical of a scenario where the system and methods described herein are used.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements (e.g. switches, detectors, and the like) shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A method of selectively enabling an auto-shutoff feature of a control system, the control system part of a headset for an aircraft, the method comprising:

plugging the headset into a headset jack in the aircraft;

toggling a power switch to initiate a startup sequence and power up the control system, wherein the power switch is configured to power down the control system if toggled when the control system is powered up;

after initiating the startup sequence and during the startup sequence, checking for a bias voltage applied to a signal line of the headset by the aircraft; and enabling the auto-shutoff feature if the bias voltage is detected during the startup sequence, the auto-shutoff feature, when enabled, allowing the control system to power down if no bias voltage is detected for a predetermined time interval, wherein if no bias voltage is detected during the startup sequence, the auto-shutoff feature is disabled.

2. The method of claim 1, wherein the auto-shutoff feature also checks for active stimuli of the headset, the auto-shutoff feature, when enabled, only powering down the control system when neither bias voltage nor active stimuli are detected for the predetermined time interval.

3. The method of claim 2, wherein the active stimuli include a telephone call over Bluetooth.

4. The method of claim 1, wherein the control system controls features of audio communication conducted via the headset.

5. The method of claim 4, wherein the control system includes a circuit providing a noise cancelling feature to the headset.

6. The method of claim 1, wherein plugging the headset into the headset jack provides power to a microphone of the headset.

7. The method of claim 1, wherein the predetermined time interval is substantially 60 seconds.

8. A control system for a headset for an aircraft comprising:

a headset plug configured to connect the headset to a headset jack in the aircraft;

a bias voltage detector configured to detect a bias voltage applied to a signal line of the headset by the aircraft;

a power switch configured such that when toggled when the control system is in a powered down state, a startup sequence is initiated for the control system, the power switch further configured such that when toggled when the control system is in a powered up state, the control system is switched into the powered down state; and a controller configured to enable an auto-shutoff feature when the bias voltage detector detects the bias voltage from the aircraft during the startup sequence, the auto-shutoff feature, when enabled, allowing the control system to power down when no bias voltage is detected for a predetermined time interval, wherein if no bias voltage is detected during the startup sequence, the auto-shutoff feature is disabled by the controller.

9. The control system of claim 8, wherein the auto-shutoff feature is further configured to check for active stimuli of the headset, the auto-shutoff feature only powering down the control system when neither bias voltage nor active stimuli are detected for the predetermined time interval.

10. The control system of claim 9, wherein the active stimuli include a telephone call over Bluetooth.

11. The control system of claim 8, wherein the control system is configured to control audio communication conducted via the headset.

12. The control system of claim 11, further comprising a circuit configured to provide a noise cancelling feature to the headset.

13. The control system of claim 8, wherein the predetermined time interval is substantially 60 seconds.

14. An aviation headset for an aircraft comprising:

a microphone connected to a signal line;

a headset plug configured to connect the signal line to a headset jack in the aircraft to electrically connect the aviation headset and the aircraft; and a battery configured to power a control system of the aviation headset, the control system comprising:

a circuit providing a noise cancellation feature to the aviation headset;

a bias voltage detector configured to detect a bias voltage applied to the signal line by the aircraft;

at least one sensor for detecting active stimuli on the signal line;

a power switch configured such that when toggled when the control system is in a powered down state, a startup sequence is initiated for the control system, the power switch further configured such that when toggled when the control system is a powered up state, the control system is switched into the powered down state; and a controller configured to enable an auto-shutoff feature for the headset when the bias voltage detector detects the bias voltage from the aircraft during the startup sequence, the auto-shutoff feature, when enabled, allowing the control system to power when neither a bias voltage nor active stimuli are detected for a predetermined time interval, wherein if no bias voltage is detected during the startup sequence, the auto-shutoff feature is disabled by the controller.

15. The aviation headset of claim 14, wherein the signal line is configured to provide power from the aircraft to the microphone when the aviation headset is connected to the aircraft.

* * * * *